US009664361B2

(12) United States Patent
Hansen

(10) Patent No.: US 9,664,361 B2
(45) Date of Patent: May 30, 2017

(54) LIGHT EFFECT SYSTEM FOR FORMING A LIGHT BEAM

(75) Inventor: Claus Ellevang Hansen, Hornslet (DK)

(73) Assignee: Martin Professional ApS, Aarhus N. (DK)

( * ) Notice: Subject to any disclaimer, the term of this patent is extended or adjusted under 35 U.S.C. 154(b) by 163 days.

(21) Appl. No.: 13/822,043

(22) PCT Filed: Sep. 8, 2011

(86) PCT No.: PCT/DK2011/050334

§ 371 (c)(1),
(2), (4) Date: Jul. 16, 2013

(87) PCT Pub. No.: WO2012/031599

PCT Pub. Date: Mar. 15, 2012

(65) Prior Publication Data

US 2013/0294080 A1 Nov. 7, 2013

(30) Foreign Application Priority Data

Sep. 10, 2010 (DK) ..... 2010 00811

(51) Int. Cl.
*F21S 8/00* (2006.01)
*F21V 21/30* (2006.01)
(Continued)

(52) U.S. Cl.
CPC ..... *F21V 21/30* (2013.01); *F21S 10/00* (2013.01); *F21S 10/007* (2013.01); *F21V 9/08* (2013.01);
(Continued)

(58) Field of Classification Search
CPC ..... F21V 7/0058; F21V 5/008; F21V 5/046; F21V 5/048; F21V 9/08; F21V 21/30;
(Continued)

(56) References Cited

U.S. PATENT DOCUMENTS 3,366,786 A * 1/1968 Delano ..... F21S 10/007 359/616
3,600,076 A * 8/1971 Synder ..... G09F 19/18 353/1
(Continued)

FOREIGN PATENT DOCUMENTS

CN 2502122 7/2002
CN 201416832 3/2010
(Continued)

OTHER PUBLICATIONS

STIC English translation of document JP2004294985.*
(Continued)

*Primary Examiner* — Jason Moon Han
*Assistant Examiner* — Omar Rojas Cadima
(74) *Attorney, Agent, or Firm* — Blank Rome LLP

(57) ABSTRACT

The present invention relates to a light effect system for forming a light beam. The light effect system comprises a first light forming means adapted to form at least a part of the light beam where at least a first actuator is adapted to rotate the first light forming means around a first rotational point and around an first axis substantially parallel to the central axis of the light beam. At least a second actuator is adapted to move the first light forming means in relation to the light beam, such that first rotational point is moved in an area outside the light beam and radially in relation to the central axis of the light beam.

20 Claims, 9 Drawing Sheets

(51) Int. Cl.

| | |
|---|---|
| ***F21S 10/00*** | (2006.01) |
| ***F21V 9/08*** | (2006.01) |
| ***F21V 11/18*** | (2006.01) |
| ***F21V 14/08*** | (2006.01) |
| *F21W 131/406* | (2006.01) |

(52) U.S. Cl.
CPC ..... *F21V 11/18* (2013.01); *F21V 14/08* (2013.01); *F21W 2131/406* (2013.01)

(58) Field of Classification Search
CPC ..... F21V 14/08; F21V 11/18; F21V 11/06; F21V 13/08; F21V 14/006; F21S 10/00; F21S 10/007; F21W 2131/406
USPC ..... 362/269, 277–284, 290, 321, 324; 359/891, 887, 738, 589; 353/84, 38, 120; 348/744; 341/106
See application file for complete search history.

(56) References Cited

U.S. PATENT DOCUMENTS

| | | | | |
|---|---|---|---|---|
| 5,934,794 | A * | 8/1999 | Hutton | 362/283 |
| 6,744,693 | B2 * | 6/2004 | Brockmann et al. | 362/321 |
| 6,971,770 | B2 * | 12/2005 | Rasmussen et al. | 362/293 |
| 7,922,337 | B2 * | 4/2011 | Glent-Madsen | G02B 26/04 250/205 |
| 2004/0055192 | A1 | 3/2004 | Rowland | |
| 2005/0063082 | A1 * | 3/2005 | Davis | G02B 26/008 359/889 |
| 2005/0206328 | A1 | 9/2005 | Hunt | |
| 2006/0034089 | A1 * | 2/2006 | Rasmussen et al. | 362/382 |
| 2007/0195207 | A1 * | 8/2007 | Wang | 348/744 |
| 2008/0106703 | A1 | 5/2008 | Miyazawa | |

FOREIGN PATENT DOCUMENTS

| | | | |
|---|---|---|---|
| EP | 0248974 | | 5/1986 |
| EP | 0248974 | | 12/1987 |
| EP | 0749250 | | 6/1996 |
| EP | 0749250 | | 12/1996 |
| GB | 2305497 | | 4/1997 |
| JP | 2004294985 | A * | 10/2004 |
| WO | WO2007134609 | | 11/2007 |
| WO | WO20071346809 | | 11/2007 |
| WO | WO2011029449 | | 3/2011 |
| WO | WO2011119450 | | 9/2011 |

OTHER PUBLICATIONS

International Search Report; International Application No. PCT/DK2011/050334; International Filing Date: Sep. 8, 2011; 5 pages.
English translation of Search Report dated Dec. 20, 2013; issued for corresponding Chinese Application No. 2011800427586; 2 pages.
English abstract of Chinese Application No. CN201416832; 1 page.
English abstract of Chinese Application No. CN2502122; 1 page.

* cited by examiner

LIGHT EFFECT SYSTEM FOR FORMING A LIGHT BEAM

FIELD OF THE INVENTION

The present invention relates to a light effect system for forming a light beam, said light effect system comprises first light forming means adapted to form at least a part of the light beam where at least a first actuator is adapted to rotate the first light forming means around a first rotational point and around an axis substantially parallel to the central axis of the light beam and at least a second actuator adapted to move the first light forming means in relation to said light beam.

BACKGROUND OF THE INVENTION

Light fixtures creating various effects are getting more and more used in the entertainment industry in order to create various light effects and mood lighting in connection with live shows, TV shows, sport events and/or as a part on architectural installation.

Typically entertainment light fixtures create a light beam having a beam width and a divergence and can for instance be wash/flood fixtures creating a relatively wide light beam with a uniform light distribution or it can be profile fixtures adapted to project an image onto a target surface. Light effects created by rotating various types of beam modifiers such as GOBOs, prisms and frost filters with rotational point around the central axis of the light beam are widely known in the art of entertainment lighting. Animation effects where an animation like light effect is created by rotating effect wheel around a rotational point outside the light beam is also known. Framing systems where a number of framing blades can be moved in and out of the light beam are known. Most entertainment light fixtures comprise thus the same type of beam modifiers and create thus the same type of light effects.

WO2007/098764 discloses a lens system comprising at least one lens, which lens system primarily applies for use in a light assembly comprising at least one light source, which generates a beam of light into light forming means and further through a front lens. The lens system comprises at least one supplementary optical component, which supplementary optical component is moved in or out of the light beam by first actuating means, which first actuating means is moving the supplementary optical component in a rotating movement around a rotation axis from a first position outside the light beam into a second position in the light beam, which rotation axis has a direction mostly perpendicular to the light beam.

U.S. Pat. No. 6,971,770 discloses a lighting apparatus including an effect wheel which is mounted on a rotation mechanism. The rotation mechanism is mounted on a mechanism which moves the effect wheel from a position outside of the light path to a position in which the effect wheel intersects the light path to provide a continuous wheel effect. The translation mechanism can move the effect wheel between positions in which the effect wheel crosses the light path in a horizontal direction and in a vertical direction, respectively. The apparatus allows a continuous wheel effect to be added to a multi-purpose luminaire and also allows the direction of travel of the continuous wheel effect across the illuminated field to be continuously varied.

WO9636834, WO03023513, WO07134609, disclose framing systems according to prior art where a number of shutter blades surrounds the light beam and can be moved in and out of the light beam by a number of actuators.

EP 1 516 14 discloses an apparatus for shaping a light beam in a lighting device, comprising a planar occluding element arranged in a plane generally orthogonal to the axis of the light beam and a support disc disposed parallel to the occluding element, wherein the occluding element is rotatably mounted on the support disc for rotation about a first axis, parallel to the axis of the light beam and movable in a path offset from the axis of the light beam and wherein the support disc is rotatable about the axis of the light beam to move the first axis in a circular orbit about the axis of the light beam.

Light designers want as many effects as possible in a lighting apparatus as these results in many effect options when creating light shows. However it is difficult to provide lighting apparatus with many effects as each kind of effect take up space in the lighting apparatus. Especially it is difficult to provide many light effects in projecting light devices as the light forming element need to be positioned in a focal point of the optical system, and typical optical systems are only capable of focusing in a very limited area. It is thus not possible to provide light apparatus with both an effect wheel as disclosed by U.S. Pat. No. 6,971,770 and a framing system as disclosed by WO9636834, WO03023513 or WO07134609. Further light designers often want to create special and spectacular shows and there is thus a need for new light effects.

DESCRIPTION OF THE INVENTION

The object of the present invention is to provide new and exciting effects to entertainment light fixtures. This is achieved by a light effect system, illumination device and method as described in the independent claims. The dependent claims describe possible embodiments of the present invention. The advantages and benefits of the present invention are described in the detailed description of the invention.

DETAILED DESCRIPTION OF THE INVENTION

The present invention is described in view of the accompanying drawing. The person skilled in the art will realize that the drawings are illustrating the principles behind the present invention and do not serve as detailed specifications showing final embodiments. The illumination device when carried out may thus differ for the illustrated embodiments and may also comprise further components.

Figure 1A:
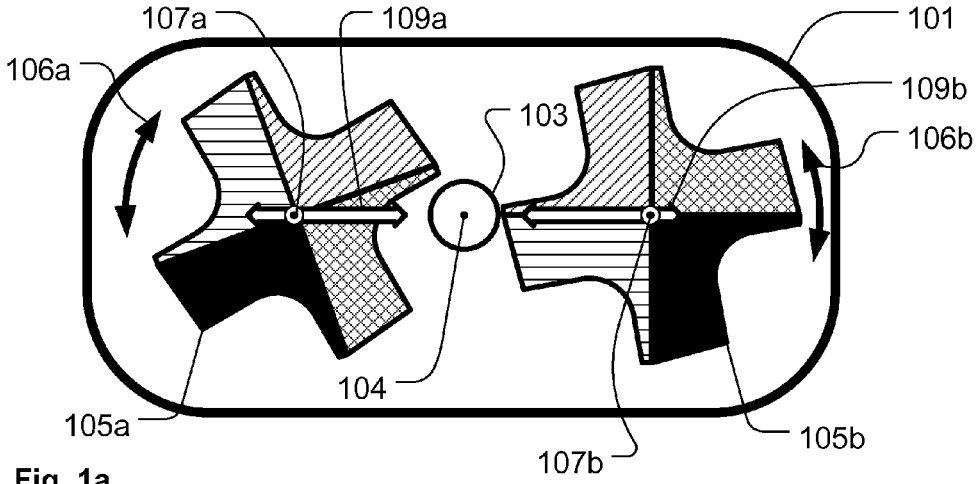
FIGS. 1*a*, 1*b* and 1*c* illustrate a top view of the light effect system in respectively a first setting, second setting and third setting.
Figure 1B:
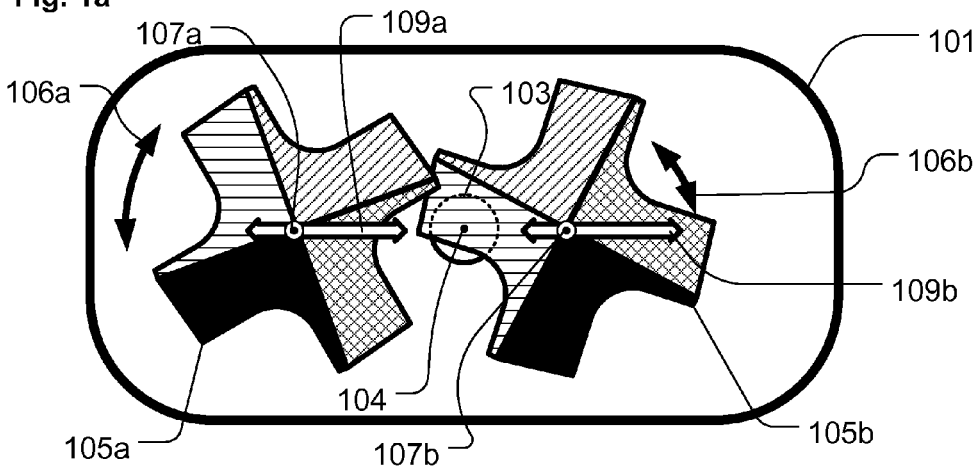
Figure 1C:
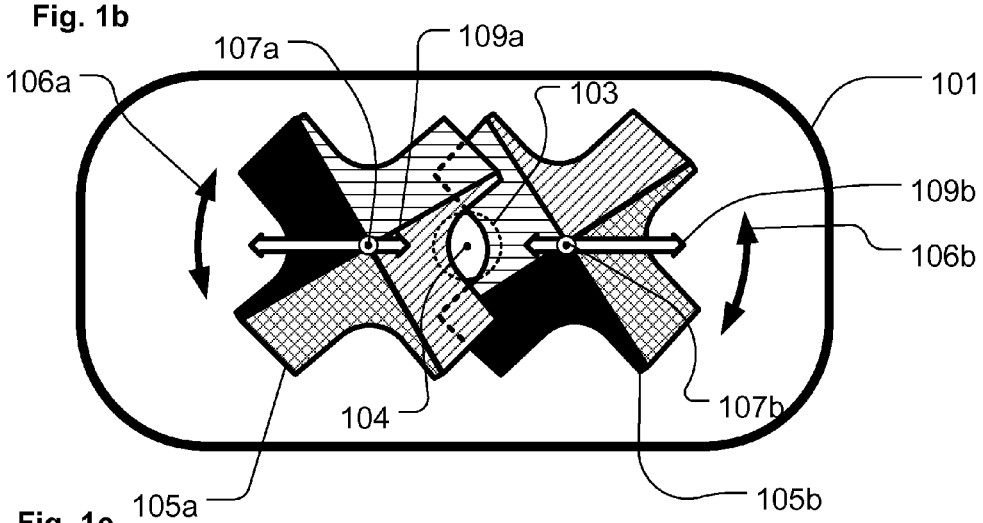

FIGS. 1*a*, 1*b* and 1*c* illustrate a top view of the light effect system in respectively a first setting, second setting and third setting. The light effect system is adapted to form a light beam and is mounted on a mounting plate 101 having an aperture 103 where through the light beam passes. In the illustrated embodiment the light beam will be delimited by the aperture and has a central axis 104 in the center of the aperture.

The light effect system comprises first light forming means 105*a* adapted to form the light beam. The first light forming means can by a first actuator (not shown in FIG. 1*a*-1*c*) be rotated as illustrated by arrow 106*a* around a first rotational point 107*a* and around an axis substantially parallel to the central axis 104 the light beam. The first light forming means can by a second actuator (not illustrated in FIG. 1*a*-1*b*) be moved in and out of the light beam as indicated by arrow 109*a* and will when positioned inside the light beam modify/form the light beam. The second actuator is adapted to move the first rotational point 107*a* in an area outside the light beam and radially to the central axis of said light beam. This means that the first rotational point moves in a linear direction towards to central axis of the light beam without entering the light beam. In other words the first rotational point is prevented from entering the light beam. Hereby is achieved that many light forming means can be positioned in substantially the same plane at the same time inside the light beam where each light forming means gradually can be moved in and out of the light beam and also rotate continuously around its' rotational point. This is not possible with prior art (U.S. Pat. No. 6,971,770) effect wheel systems, where the rotational point of the effect wheel moves tangentially in relation to the center of the light beam. The tangentially movement in the prior effect systems result in a longer path of movement and neighboring light forming means many not be provide in substantially the same plane, as tangentially moving paths would overlap. By moving the rotational point 107*a* radially towards the center axis of the light beam makes it possible to integrated more than one light forming means into the same light effect system, as the moving paths can be provided radially around the light beam and thus not overlaps. Further in situations, where the outer edge of the light forming means is used to delimit the light beam as known from framing systems, the radially movement of the light forming means makes it easier to control the light forming means compared to moving light forming means moving tangentially in relation the light beam, as the controlling means does not need to compensate for the offset of the tangentially moving path when moving the light forming means in and out of the light beam in a static position where the light forming means is not rotating.

The light effect system comprises further second light forming means 105*b* adapted to form the light beam. The second light forming means can by a third actuator (not shown in FIG. 1*a*-1*c*) be rotated as illustrated by arrow 106*b* around a rotational point 107*b* and around an axis substantially parallel to the central axis 104 the light beam. The first light forming means can by a third actuator (not illustrated in FIG. 1*a*-1*b*) be moved in and out of the light beam as indicated by arrow 109*b* and will when positioned inside the light beam modify/form the light beam. The fourth actuator is adapted to move the second rotational point 107*b* in an area outside the light beam and radially to the central axis of said light beam. This means that the second rotational point moves in a linear direction towards to central axis of the light beam without entering the light beam. In other words the second rotational point is prevented from entering the light beam.

Each light forming means 105*a* and 105*b* can thus be moved linearly in and out of the light beam in a direction towards the center of the light beam and further be rotated around a rotational point which is positioned outside the light beam. A simple framing system is hereby provided as the edge of each light forming means can be used as framing blades delimiting the light beam. The radially movement of the light forming means makes it possible to gradually insert each light forming means into the light beam and the framing of the light beam can be adjusted by rotting the light forming means around the rotational point. The light effect system can further also be used to create an animation effect as the light forming means can continuously be rotated around the rotational point. FIG. 1*a* illustrates a situation where both the first 105*a* and second 105*b* light forming means are positioned outside the light beam no light are created by the light forming means in this setting. FIG. 1*b* illustrates a setting where the second light forming means 105*b* have been moved into the light beam by moving the second rotational point 107*b* in radially direction towards the central axis of the light beam and the second light forming means 105*b* has hereafter been rotate around the rotational point 107*b* by the first actuator whereby the wanted framing have been achieved. FIG. 1*c* illustrates a setting where the first light forming means 105*a* also have been inserted into the light beam and both light forming means contribute to the forming of the light beam.

FIG. 1*a*-1*c* illustrate further that the first rotational point 107*a* and the second rotational point 107*b* are being arranged at opposite sides of said light beam. This ensures that the light forming means can be moved symmetrical inside the light beam which makes it easy to set up light effect system e.g. due to the fact that substantially the same software modules can be used for the controllers controlling the actuators performing the movement and rotation of the light forming means.

Figure 2A:
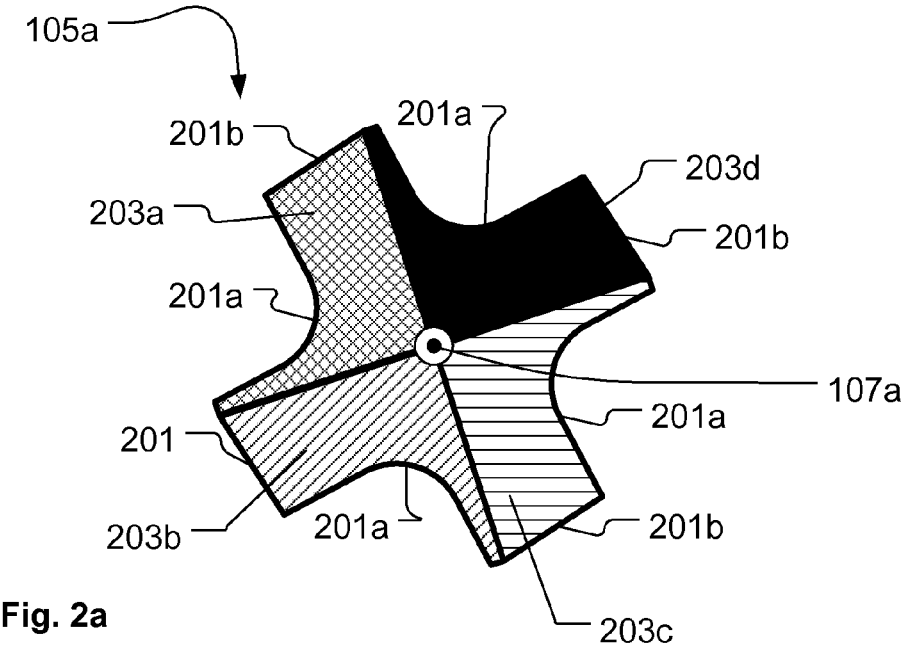
FIGS. 2*a* and 2*b* illustrates the light forming means used in the light effect system of FIG. 1*a*-1*c;*
Figure 2B:
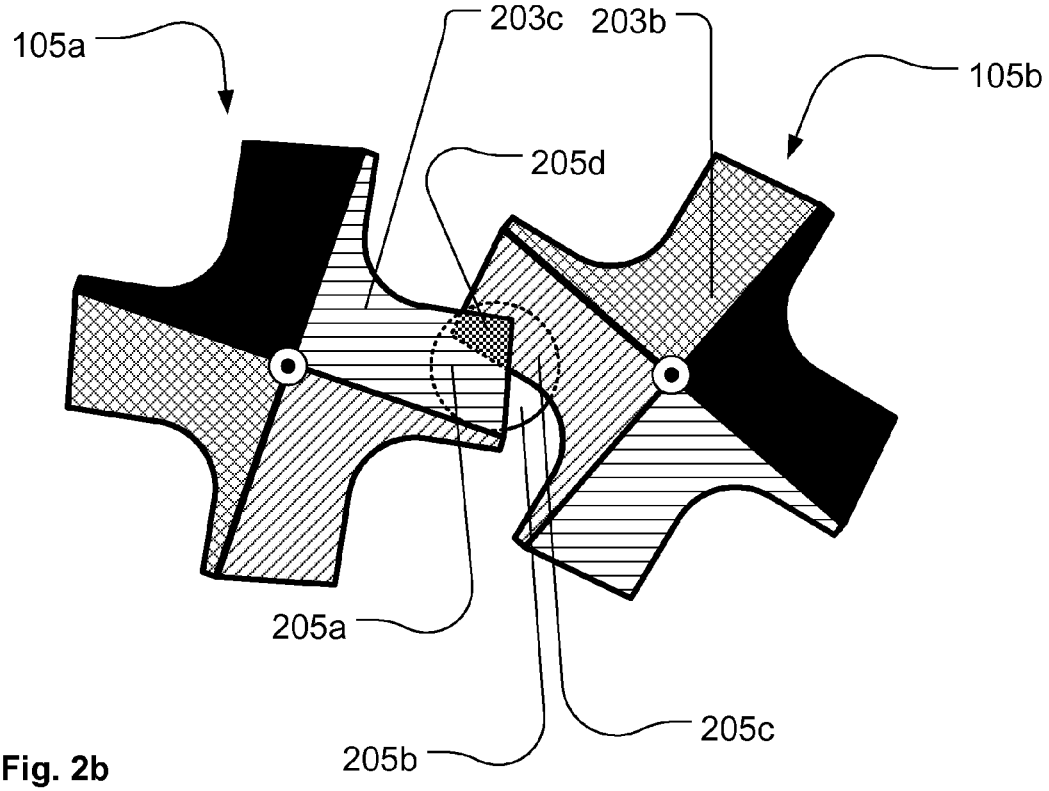

FIG. 2*a* illustrates the light forming means 105*a* used in the light effect system of FIG. 1*a*-1*b*. The outer perimeter of the light forming means is formed as a number of light effect edges. In the illustrated embodiment the light forming means comprises a number of curved light forming edges 201*a*, a number of substantial linear light forming edges 201*b*. The light effect edges serve to delimit the light beam when the light forming means are positioned partially inside the light beam and the shape of the light effect edge determines how the light beam are delimited. The light effect edge can both be used in projecting devices where an image of the delimited light beam are created on a target surface for instance by a projecting system or in wash lights where the delimited light beam are used to create mid air effects. The light forming means 105*a* comprises also a number of light effect regions 203*a*, 203*b*, 203*c* and 203*d* formed in the area between the outer perimeter and the rotational point 107*a*. In the illustrated embodiment the light effect regions are 203*a*, 203*b* and 203*c* are formed as a number of different color filters adjacent to the light effect region. This makes is possible to divide the light beam into parts having different colors by placing the light effect region partially in the light beam. It for instance possible as illustrated in FIG. 2*b* to provide a first beam part having a first color 205*a* created by light effect region 203*c* of the first light forming means 105*a*, a second part 205*b* of white color as this part passes uneffected through the light effect system and a third part 205*c* having a second color created by the light effect region 203*b* of the second light forming means. A fourth part 205*d* having a third color is created by a combination of light effect region 203*c* of the first light forming means 105*a* and light effect region 203*b* of the second light forming means. This light effect is useful both as a mid air effect where the light beam will appear as a multicolored light beam and as a projected image of the light effect system. Light effect region 203*d* is formed in a non transparent material and can thus be used a framing blades where light effect edge delimits the light beam.

FIG. 3*a*-3*e* illustrates possible embodiments of light forming means which can be used in light effect system according to the present invention.

Figure 3A:
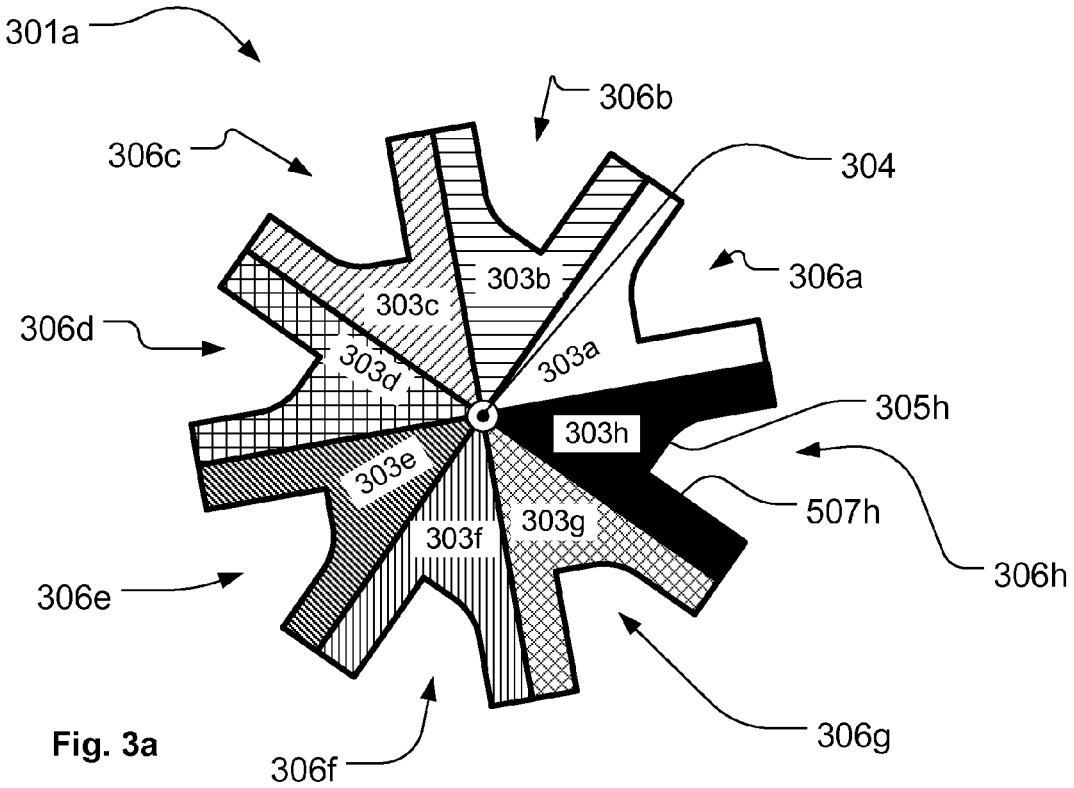
FIG. 3*a*-3*e* illustrates possible embodiments of light forming means which can be used in light effect system according to the present invention.
Figure 3B:
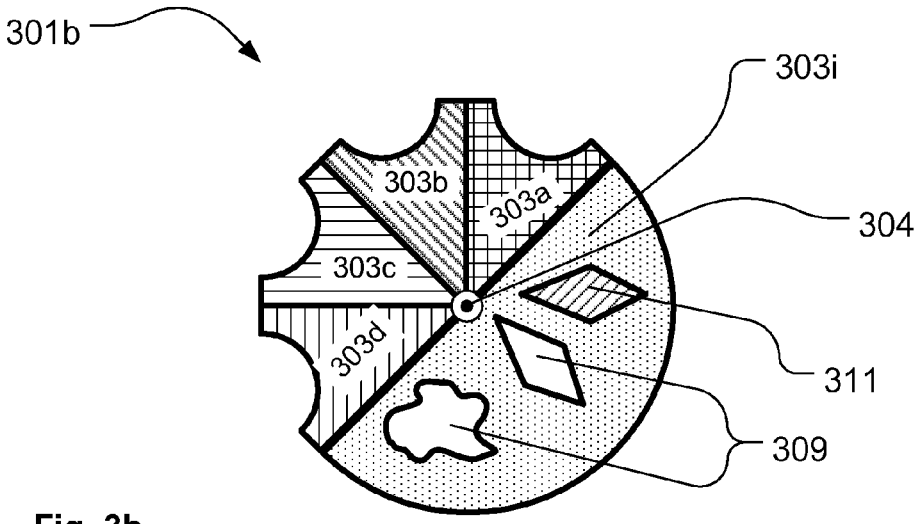

FIG. 3*a* illustrates an embodiment of the light forming means 301*a* where the light effect regions have been embodied as 7 color regions 303*a*-303*g* and a non transparent region 303*h*, which have been distributed around the rotational point 304. Each light effect regions has a shaped outer perimeter constituting light effect edge 306*a*-306*g*. Each light effect edge comprises at least two sides being substantial perpendicular to each other. Only the two perpendicular sides 305*h* and 307*h* of the light effect edge of light effect region have been marked in drawing. This provides the possibility of shaping the light beam with two orthogonal sides. It is thus possible, with a light effect system as illustrated in FIG. 1*a*-1*b* with two light forming means comprising a light effect edge having two perpendicular sides, to create a rectangular delimiting of the light beam. The skilled person realize that the light forming means may comprise any number of light effect regions and also comprise a single light effect region such as complete textured glass wheels or complete animation wheels.

The light forming means 303*b* illustrated in FIG. 3*a* has 4 light effect regions 303*a*-303*d* occupying one half of the light forming means and a large light effect region occupying the second half of the light forming means 301*b*. The large effect region comprises a number of apertures 309 which can be used to shape the light beam and can have any shape. The large effect region 303*i* comprises also an effect aperture 311 comprising a light effect. The light effect can for instance be color effect, frost effects, prism effects etc.

Figure 3C:
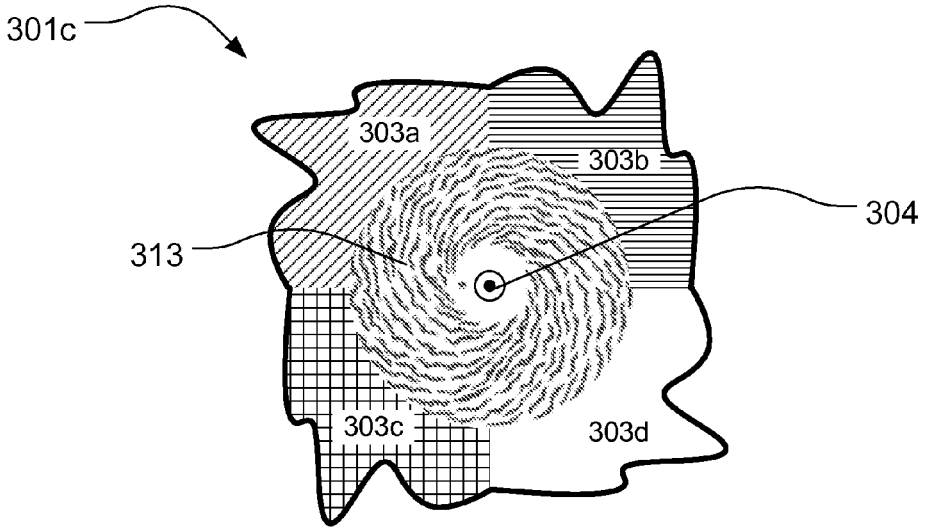

The light forming means 303*c* illustrated in FIG. 3*c* has 4 light effect regions 303*a*-303*d* each occupying ¼ of the light forming means 301*c* and where an inner light effect region 313 is formed in the light forming means between the rotational point of the light forming means and the 4 light effect regions. The inner light effect region differs from the 4 light effect regions and can cover the entire light beam. The inner effect region 313 can then comprise an animation pattern which generates a continuous animation effect when the light forming means are rotated around the rotational point. The light forming means can in this embodiment be used to generate both framing effects and animation effects in the same light effect module which increase the number of light effects in the lighting apparatus. The skilled person realizes that other optical effects like textured glass, other colors, gobos etc. also can be implemented in the inner light effect region.

Figure 3D:
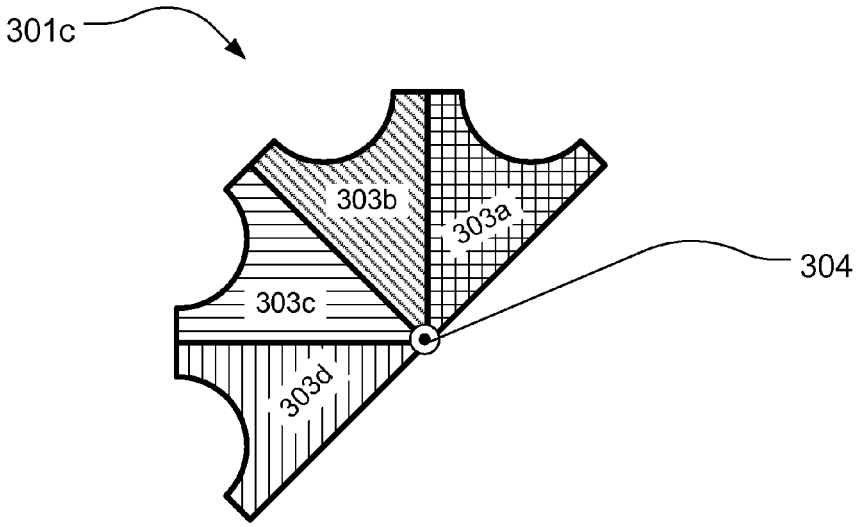

FIG. 3*d* illustrates that the light forming means 301*d* can be embodied such that only the light effect edge and light effect regions are placed on one side in relation the rotational point. This reduces the amount of light effects that can be embodied in the light forming means 301*d*, however it reduces also the amount of space needed around the light beam, which can be useful in illumination devices where the amount of space is limited.

Figure 3E:
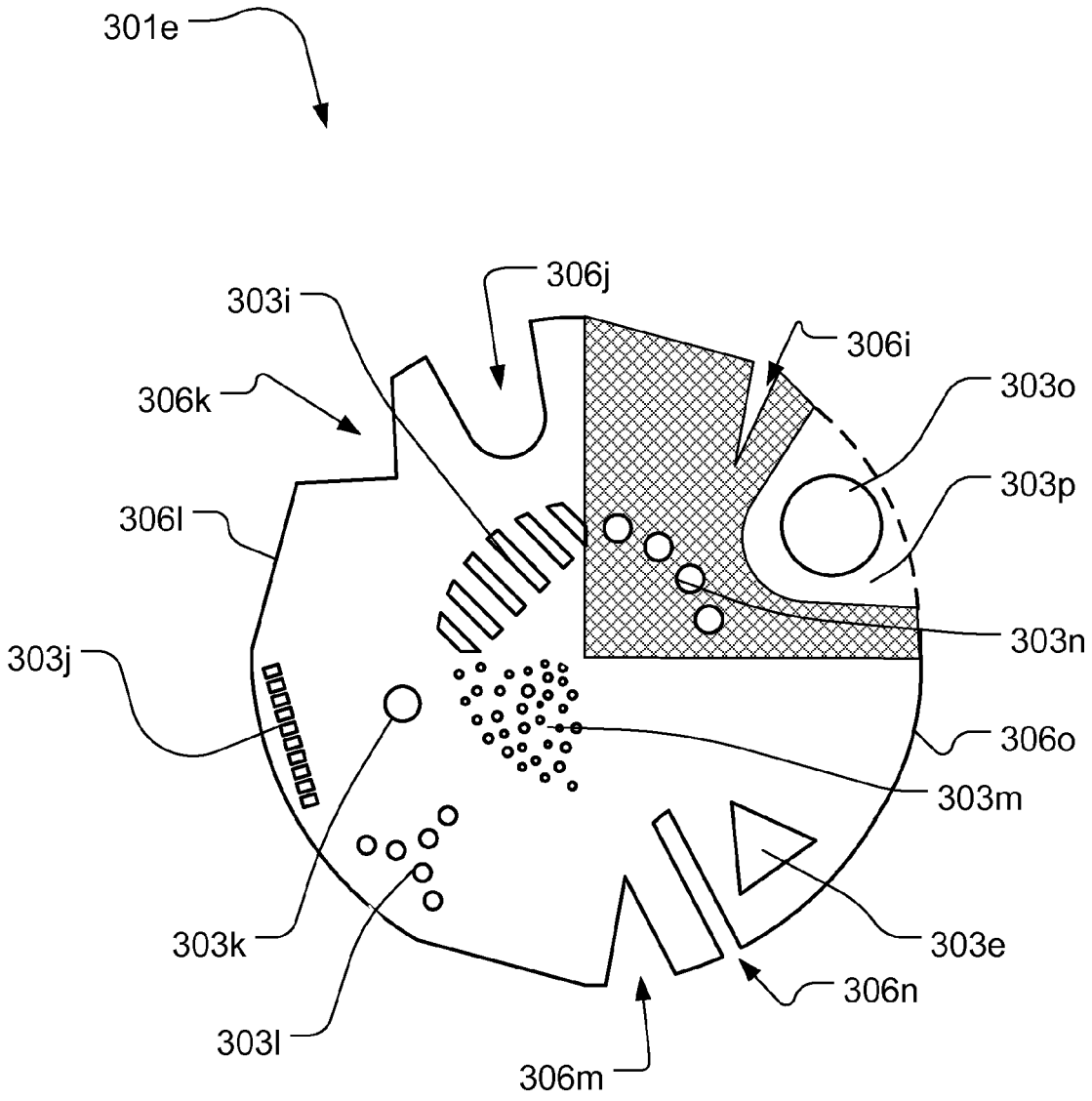

FIG. 3*e* illustrates a light forming means 301*e* comprising a number of light effect edges (transparent or non-transparent) 306*a*-306*f* having different shapes and a number of light effect regions 303*a*-303*g* where:

- light effect edge 306*i* is a sharp angled edge;
- light effect edge 306*j* is a linear cutout with a circular bottom;
- light effect edge 306*k* is a right angled edge;
- light effect edge 306*l* is a straight edge;
- light effect edge 306*m* is a sharp angled edge with a larger angle than light effect edge 306*i;*
- light effect edge 306*n* is a rectangular edge;
- light effect edge 306*o* is an arc shaped edge;
- light effect region 303*i* is a number of rectangular apertures evt. with different color filters for creating ripple effects or 4 color patterns;
- light effect region 303*j* is a number of squared apertures evt. with different color filters arranged on straight line for creating ripple effects or 4 color patterns;
- light effect region 303*k* is a circular aperture for creating a well defined circular beam;
- light effect region 303*l* is a collection of circular apertures evt. with different color filters for creation a pattern of well defined light beams or projecting the corresponding pattern to a target surface and when 2 different color sections from two different light forming means are overlayed it creates a 3 color symmetric pattern;
- light effect region 303*m* is a collection of small apertures which can be used to create a star pattern which can be projected onto a target surface;
- light effect region 303*n* is a collection of circular aperture arranged in a color filter or monochrome coated glass;
- light effect region 303*o* is a "floating" effect region which is surrounded by a transparent region 303*p*. The "floating" effect region can for instance be used to create light effect in the middle of the light beam. The transparent region 303*p* can for instance be embodied as glass and the floating region can be an effect material added to the glass material as known in the art of manufacturing color filters and/or gobos.
- Light effect region 303*e* is a triangular shaped aperture for creating a well defined triangular beam. When 2 different color sections are overlayed it creates a 3 color symmetric star pattern.

The illustrated light forming means can for instance be created by a glass material where the color filters (dichroic filters) and non transparent regions have been coated onto the glass and/or where the transparent regions have been etched away. It is also possible to construct the light forming means of metal sheets where the apertures have been uncreated by cutaways.

Figure 4A:
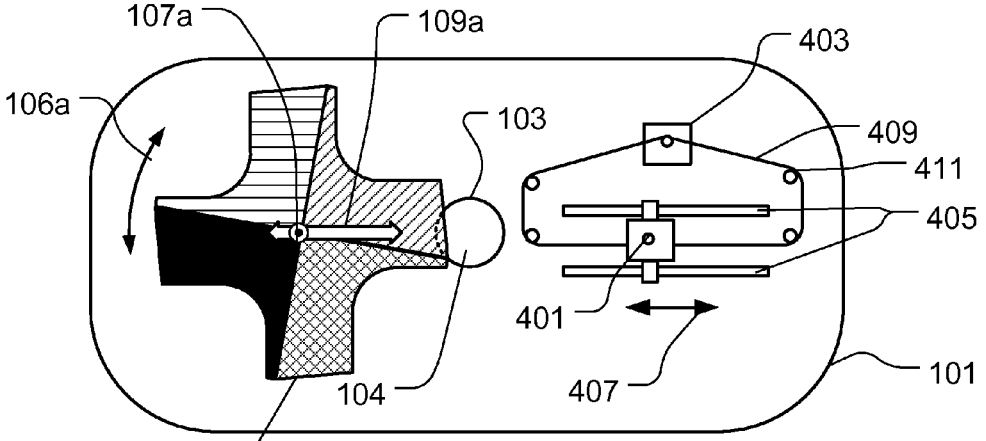
FIGS. 4*a* and 4*b* illustrates respectively a top and side view of the light effect system and illustrates possible embodiments of the mechanical system.
Figure 4B:
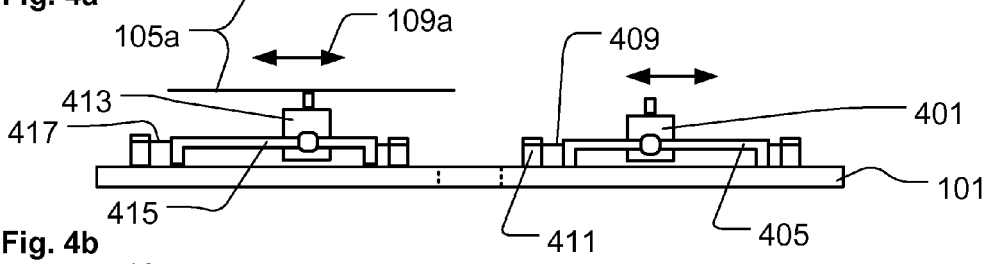

FIGS. 4*a* and 4*b* illustrates respectively a top and side view of the light effect system of FIG. 1*a*-1*b*, where the second light forming means 105*b* have been removed in order to illustrate one embodiment of the third actuator 401 and the fourth actuator 403. In this embodiment the second light forming means (not shown) is mounted to the output shaft of the third actuator 401 which hereby can rotate the second light forming means. The third actuator is arranged in a linear guiding system comprising two tracks mounted to the mounting plate 101 and along which the third actuator can move as illustrated by arrow 407. The fourth actuator 403 interacts with a drive belt 409 which wrapped around a number of pulleys 411 and connected to the third actuator.

The fourth actuator can rotate the drive belt in both directions and the drive belt 409 can thus pull the motor along the guiding tracks in both directions. The second rotational point of the second light forming means can thus be moved radially to the central axis of the light beam and outside the light beam. The side view in FIG. 4*b* illustrates that the first light forming means 105*a* is rotated and moved by a similar system where a first actuator 413 rotates the first light forming means 105*a* and a second actuator (not shown) moves the first actuator along a guiding track 415 using a drive belt 417.

Figure 5A:
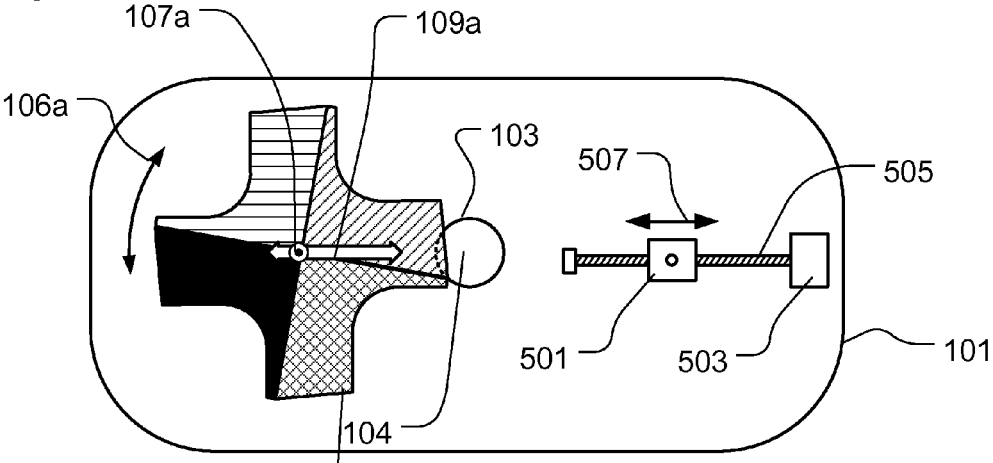
FIGS. 5*a* and 5*b* illustrates respectively a top and side view of the light effect system and illustrates possible embodiments of the mechanical system.
Figure 5B:
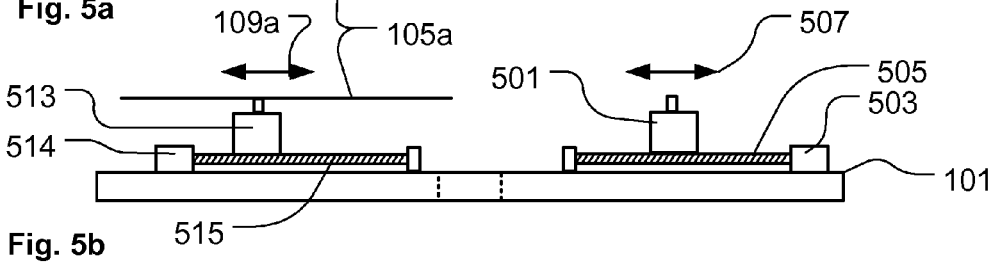

FIGS. 5*a* and 5*b* illustrates respectively a top and side view of the light effect system of FIG. 1*a*-1*b*, where the second light forming means 105*b* have been removed in order to illustrate another embodiment of the third actuator 501 and the third actuator 503. In this embodiment the second light forming means (not shown) is mounted to the output shaft of the third actuator 501 which can rotate the second light forming means. The third actuator is arranged on a linear spindle 505 through a gear mechanism and will move along the spindle 505 when the spindle is rotated. The spindle is arranged radially to the central axis 104 of the light beam and can be rotated by the fourth actuator 503. The second rotational point of the second light forming means can thus be moved radially to the central axis 104 of the light beam and outside the light beam. The side view in FIG. 5*b* illustrates that the first light forming means 105*a* is rotated and moved by a similar system where a first actuator 513 rotates the first light forming means 105*a* and a second actuator 514 moves the first actuator along a spindle 515 by rotating the spindle.

Figure 6A:
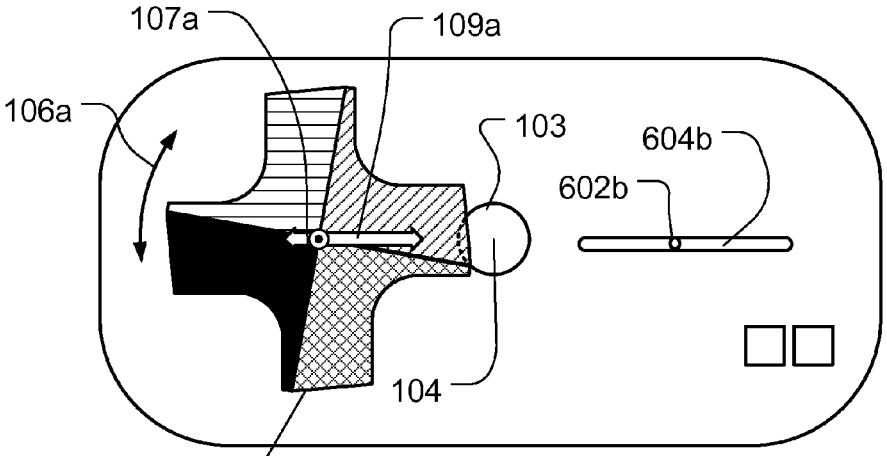
FIGS. 6*a*, 6*b* and 6*c* illustrates respectively a top, side and bottom view of the light effect system and illustrates possible embodiments of the mechanical system.
Figure 6B:
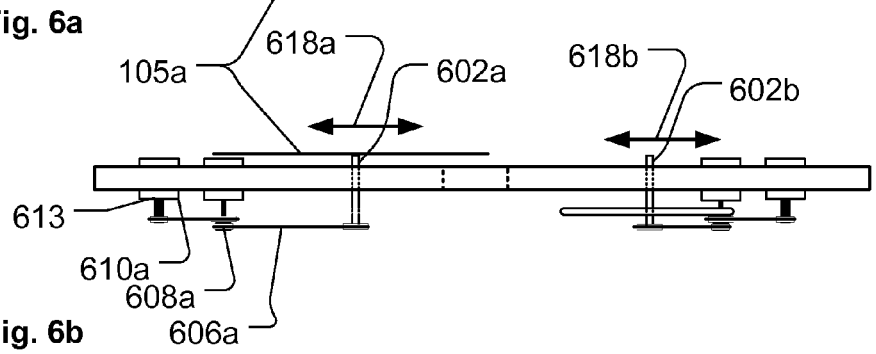
Figure 6C:
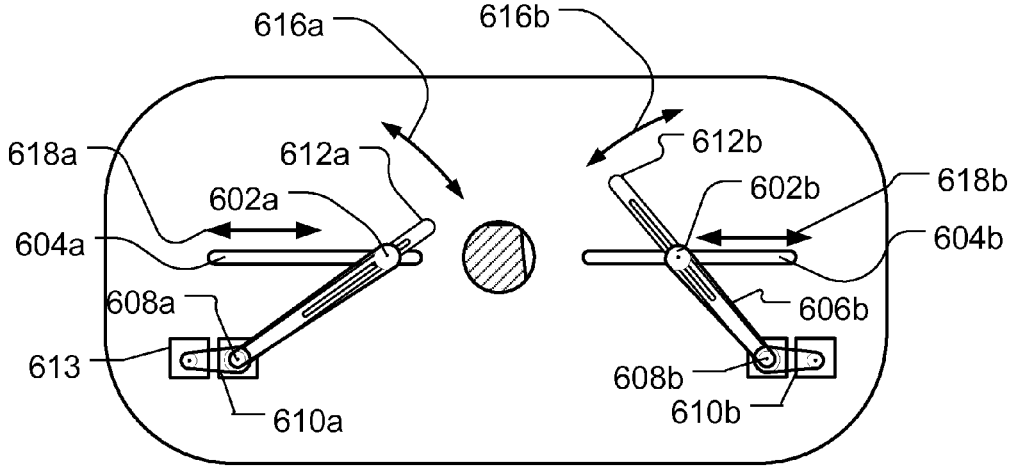

FIGS. 6*a*, 6*b* and 6*c* illustrates respectively a top, side and bottom of the light effect system of FIG. 1*a*-1*b* where the second light forming means 105*b* have been removed in order to illustrate another embodiment of the mechanisms adapted to rotate the light forming means around the rotational point and move the rotational point radially to the central axis of the light beam and outside the light beam.

In this embodiment the second light forming means are arranged at the top side of the mounting plate 101 and the mechanical drive mechanisms are arranged at the bottom side mounting plate. The first 105*a* and second (105*b* but removed in FIG. 6*a*-6*c*) light forming means are respectively mounted to a rotation axle 602*a* and 602*b*. The rotation axles 602*a* and 602*b* are arranged in a guiding slit 604*a* and 604*b* and extents through the mounting plate 101. The rotation axles 602*a* and 602*b* are mechanically connected to the first actuator 613 and the second actuator 601 respectively through elastic belts 606*a* and 606*b* connected to gear mechanism 608*a* and 608*b* which is driven by drive belt 610*a* and 610*b* connected to actuator 614 and 603. The first actuator 614 and the third actuator 601 can thus respectively rotate the light forming means as indicated by arrow 106*a*. The rotation axles 602*a* and 602*b* are also arranged in a guiding slit of displacing arms 612*a* and 612 which can be rotated by the second 614 actuator and the fourth actuator 603. Rotation (illustrated by arrows 616*a* and 616*b*) of the displacing arms 612*a* and 612*b* will result in displacement of the rotation axles 602*a* and 602*b* along the guiding slits 604*a* and 604*b* (illustrated by arrow 618*a* 618*b*), as the guiding slits 604*a* and 604*b* only allow the rotational axles 602*a* and 602*b* to be moved linearly along the slit. The rotational movement of the displacing arms 612*a* and 612*b* will also result in a movement of the rotational axles 602*a* and 602*b* along the guiding slit of the displacing arms 612*a* and 612*b*.

The circular motion of the displacing arms are thus converted into a linear motion by the guiding slits 604*a* and 604*b*.

The elastic belts 606*a* and 606*b* are designed so that they are tight in all positions in order to ensure the rotational axels 602*a* and 602*b* can be rotated by their respective actuators. It can further be seen that the actuators are mounted to the mounting plate 101 such that they extend through the mounting plate whereby the light effect system can be made thinner.

Figure 7:
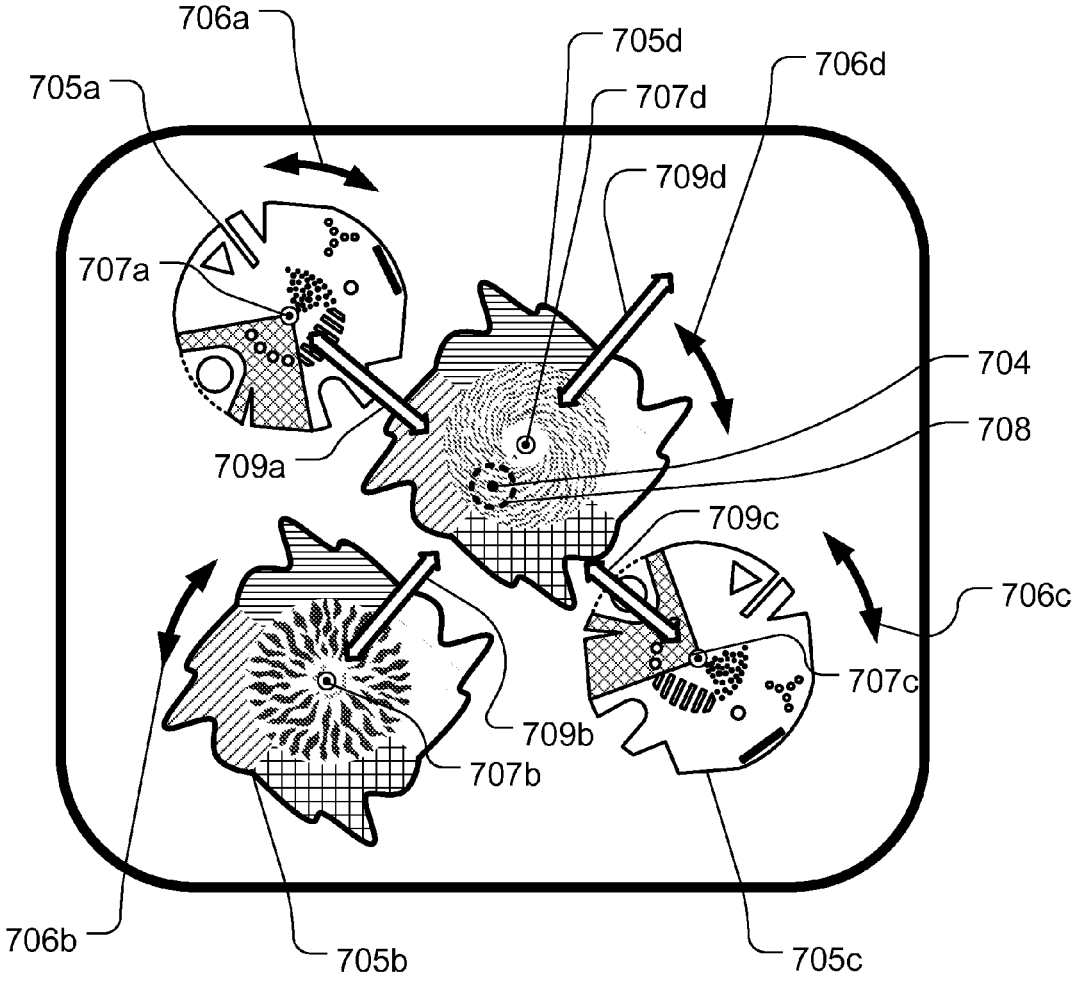
FIG. 7 illustrates another embodiment of the light effect system according to the present invention.

FIG. 7 illustrates another embodiment of the light effect system according to the present invention. The light effect system comprises four light forming means 705*a*, 705*b*, 705*c* and 705*d* adapted to form the light beam. Each light forming means can by a rotation actuator (not shown) be rotated as illustrated by arrow 706*a*, 706*b*, 706*c* and 706*d* around a rotational point 707*a*, 707*b*, 707*c* and 707*d* and around an axis substantially parallel to the central axis 704 of the light beam 708. Each light forming means can by a displacement actuator (not illustrated) be moved in and out of the light beam as indicated by arrow 709*a*, 709*b*, 709*c* and 709*d* and will when positioned inside the light beam modify/form the light beam. Each displacement actuator is adapted to move the rotational point 707*a*, 707*b*, 707*c* and 707*d* in an area outside the light beam and radially to the central axis 704 of the light beam. The light forming means are arranged in pairs where the rotational point of two light forming means are positioned on opposite sides of the light beam. Light forming means 705*a* and 705*c* constitute thus a first pair and light forming 705*b* and 705*d* constitute a second pair. The first and second pairs are further arranged perpendicular to each other.

Figure 8:
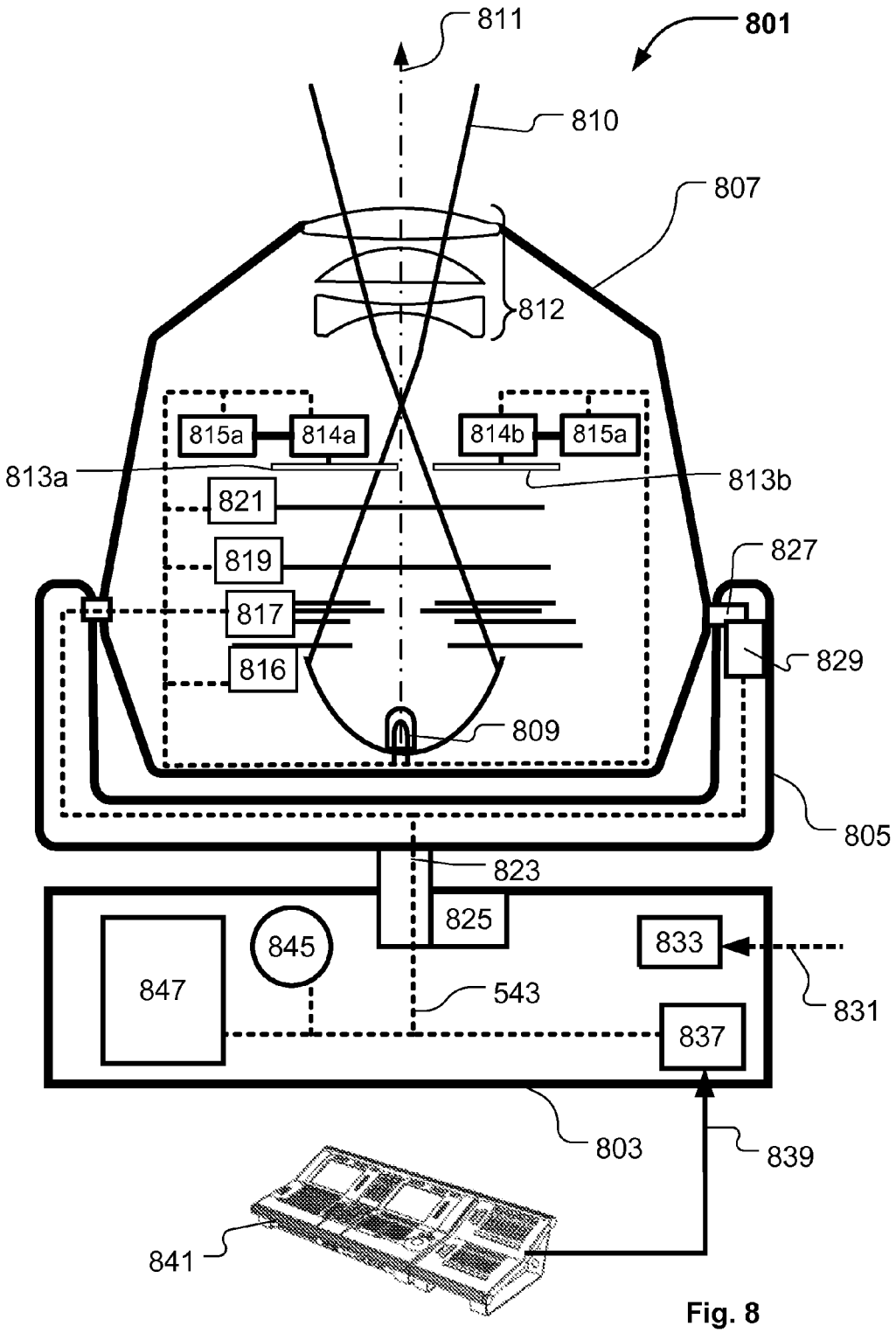
FIG. 8 is a structural diagram of an illumination device including a light effect system according to the present invention.

FIG. 8 is a structural diagram of an illumination device including a light effect system according to the present invention. The illumination device is a moving head light fixture 801, however the skilled person realizes that illumination device also can be embodied as a stationary illumination device. The moving head light fixture 801 comprises a base 803 connected to a yoke 805 and a head 807 carried in the yoke. The illumination device comprises a light source 809 generating a light beam 810 propagating along an optical axis 811 and a projecting system 812 positioned along the optical axis 811. The projecting system collects projects at least a part of the light beam. The light effect system according to the present invention is positioned between the light source and the projecting system. The first light forming means 813*a* can be rotated by first actuator 814*a* and the second actuator 815*a* can move the rotational point of the first light forming as described above. The second light forming means 813*b* can be rotated by third actuator 814*b* and the fourth actuator 815*b* can move the rotational point of the second light forming means as described above.

A number of other light effects are also positioned in the light beam and can be any light effects known in the art of intelligent lighting for instance a dimmer 816, a CMY color mixing system 817, color filters 819, gobos 821, iris (not shown, prisms (not shown) etc.

The moving head light fixture comprises first rotating means for rotating the yoke in relation to the base, for instance by rotating a shaft 823 connected to the yoke by using a motor 825 positioned in the base. The moving head light fixture comprises also second rotating means for rotating the head in relation to the yoke, for instance by rotating a shaft 527 connected to the head by using a motor 829 positioned in the yoke. The skilled person would realize that the rotation means could be constructed in many different ways using mechanical components such as motors, shafts, gears, cables, chains, transmission systems etc.

The moving head light fixture receives electrical power 831 from an external power supply (not shown). The electrical power is received by an internal power supply 833 which adapts and distributes electrical power through internal power lines (not shown) to the subsystems of the moving head. The internal power system can be constructed in many different ways for instance as one system where all subsystems are connected to the same power line. The skilled person would however realize that some of subsystems in the moving head need different kind of power and that a ground line also can be used. The light source will for instance in most applications need a different kind of power than step motors and driver circuits.

The light fixture comprises also a controller 837 which controls the other components (other subsystems) in the light fixture based on an input signal 839 indicative of at least one light effect parameter and at least one position parameter. The controller receives the input signal from a light controller 841 as known in the art of intelligent and entertainment lighting for instance by using a standard protocol like DMX, ArtNET, RDM etc. The light effect parameter is indicative of at least one light effect parameter of said light beam for instance the amount of dimming and/or the dimming speed of the light beam, a color that the CMY system 817 should mix, the kind of color filter that a color filter system 819 should position in the light beam and/or the kind of gobo that the gobo system 821 should position in the light beam, etc. The light effect parameter can also be indicative of how the first light forming means 813*a* should be moved in relation to the light beam and which light effects should be created by the first light effect parameter. The controller 837 can be adapted to send instructions to the first actuator 814*a* and the second actuator 815*a* based on the light effect parameter indicated and thereby created the wanted light effect. The second light forming means 813*a*, third actuator 814*b* and fourth actuator 815*b* can be controlled in a similar way. The controller is adapted to send commands and instructions to the different subsystems of the moving head through internal communication lines 843 (in dotted lines). The internal communication system can be based on a various type of communications networks/systems and the illustrated communication system is just one illustrating example.

The position parameter is indicative of rotation of at least said yoke in relation to said base and/or rotation of said head in relation to said yoke. The position parameter could for instance indicate a position whereto the light fixture should direct the beam, the position of the yoke in relation to the base, the position of the head in relation to the yoke, the distance/angle that the yoke should be turned in relation to the base, the distance/angle that the head should be turned in relation the base etc. The rotation parameter could also indicate the speed and time of the rotation.

The moving head can also have user input means enabling a user to interact directly with the moving head instead of using a light controller 841 to communicate with the moving head. The user input means 845 can for instance be bottoms, joysticks, touch pads, keyboard, mouse etc. The user input means could also be supported by a display 847 enabling the user to interact with the moving head through menu system shown on the display using the user input means 547. The display device and user input means can in one embodiment also be integrated as a touch screen.

The light effect system according to the present invention can be combined with a light effect system for forming a light beam as described in the applicant's pending patent application PCT/DK2010/050230 published as WO 2011/029449 and incorporated herein by reference.

The light effect system according to WO 2011/029449 comprises a base support rotatable supporting a light effect support, said light effect support comprises:

light forming means, said light forming means being adapted to form at least a part of said light beam;

at least on actuator adapted to moved said light forming means in relation to said light beam;

The light effect system comprises rotatable electric connecting means, said rotatable electric connecting enabling transferring of electric energy between said light effect support and said base support during rotation of said light effect support in relation to said base support.

The illumination device can be integrated into this light effect system by positioning the light forming means and their actuators at the light effect support. The result is that the independently controlled light beams also can be rotated continuously 360 degrees around the light beam which provides further effects.

The invention claimed is:

1. An illumination device comprising:

at least one light source generating a light beam, said light beam propagating along an optical axis; and a light effect system for forming the light beam, the light effect system comprising:

a first light former adapted to form at least a part of said light beam;

at least a first actuator adapted to rotate said first light former around a first rotational point and around an axis substantially parallel to the optical axis of said light beam;

at least a second actuator adapted to move said first light former in relation to the optical axis of said light beam;

a second light former adapted to form at least a part of said light beam;

at least a third actuator adapted to rotate said second light former around a second rotational point and around an axis substantially parallel to the optical axis of said light beam; and at least a fourth actuator adapted to move said second light former in relation to the optical axis of said light beam, wherein said second actuator is adapted to move said first rotational point in an area outside said light beam and in a linear direction radially toward the optical axis of said light beam, and said fourth actuator is adapted to move said second rotational point in an area outside said light beam and in a linear direction radially toward the optical axis of said light beam;

wherein said linear direction of said first rotational point and of said second rotational point follow a same radial line in relation to said optical axis of said light beam, said first rotational point and said second rotational point being arranged at opposite sides of said optical axis of said light beam;

wherein said first light former and said second light former each comprise at least one light effect edge, said at least one light effect edge formed in at least a part of an outer perimeter of each said light former;

a projecting system positioned along said optical axis, said projecting system projecting at least a part of said light beam, said projecting system adapted to image at least a part of said light effect system at a target surface positioned a distance along said optical axis, wherein said light effect system being positioned at least partially in said light beam and between said light source and said projecting system.

2. The illumination device according to claim 1, wherein at least one of said light formers comprise at least a first light effect region, said first light effect region being formed in said at least one of said light formers between an outer perimeter of said at least one of said light formers and first rotational point of said at least one of said light formers.

3. The illumination device according to claim 2, wherein said at least first light effect region is formed as a color filter adjacent to said at least one light effect edge.

4. The illumination device according to claim 3, wherein at least one of said light formers comprise at least one inner light effect region, said inner light effect region being formed in said at least one of said light formers between said rotational point of said at least one of said light formers and said first light effect region.

5. The illumination device according to claim 1, wherein at least one of said light formers comprise at least a first light effect region, said first light effect region being formed as a color filter adjacent to said at least one light effect edge.

6. The illumination device according to claim 5, wherein at least one of said light formers comprise at least one inner light effect region, said at least one inner light effect region being formed in at least one of said light formers between said rotational point of said light former and said first light effect region.

7. The illumination device according to claim 1, wherein said illumination device further comprises:

a base;

a yoke rotatable connected to said base; and a head rotatably connected to said yoke, said head comprising said light source, said light effect system, and said projecting system.

8. The illumination device according to claim 1, wherein at least one light effect edge further includes a plurality of linear edge portions.

9. The illumination device according to claim 8, wherein at least one light effect edge includes at least two side edges substantially perpendicular to each other.

10. The illumination device according to claim 1, wherein at least one light effect edge further includes transparent and non-transparent portions.

11. The illumination device according to claim 1, wherein said light effect system being positioned at least partially in said light beam involves at least one light effect edge, formed in said part of said outer perimeter of at least one of said light formers, being positioned partially inside said light beam, whereby said shape of said outer perimeter of at least one of said light formers determines how said light beam is delimited.

12. The illumination device according to claim 1, wherein at least one light effect edge includes a plurality of differently curved edge portions.

13. The illumination device according to claim 1, wherein said first rotational point and said second rotational point move in a linear direction in relation to said optical axis of said light beam, along the same radial line, without entering said light beam, whereby a plurality of light formers can be positioned in substantially a same plane, at a same time, inside said light beam to collectively delimit said light beam.

14. A method of forming a light beam comprising the steps of:

moving a first light former in relation to said light beam propagating along an optical axis, said first light former comprising at least one light effect edge formed in at least a part of an outer perimeter of said first light former for delimiting the light beam;

imaging at least a part of said delimited light beam at a target surface positioned a distance along said optical axis;

rotating said first light former around a first rotational point and around a first axis substantially parallel to said optical axis of said light beam;

moving a second light former in relation to said light beam propagating along said optical axis said second light former comprising at least one light effect edge formed in at least a part of an outer perimeter of said second light former for delimiting the light beam; and rotating said second light former around a second rotational point and around a second axis substantially parallel to said optical axis of said light beam;

wherein said step of moving said first light former in relation to said light beam comprises the step of moving said first rotational point in an area outside said light beam and in a linear direction radially toward to the optical axis of said light beam;

wherein said step of moving said second light former in relation to said light beam comprises the step of moving said second rotational point in an area outside said light beam and in a linear direction radially toward the optical axis of said light beam; and wherein said first rotational point and said second rotational point are moved in a linear direction along a same radial line in relation to said optical axis of said light beam, said first rotational point and said second rotational point being arranged at opposite sides of said optical axis of said light beam.

15. The method according to claim 14, wherein moving at least one of said light formers in relation to said light beam involves moving at least one light effect edge formed in said part of said outer perimeter of at least one of said light formers partially inside said light beam, whereby said shape of said at least one light effect edge determines how said light beam is delimited.

16. The method according to claim 15, wherein at least one light effect edge further includes a plurality of linear edge portions.

17. The method according to claim 16, wherein said at least one light effect edge includes at least two side edges substantially perpendicular to each other.

18. The method according to claim 14, wherein at least one light effect edge includes a plurality of differently curved edge portions.

19. The method according to claim 14, wherein said first rotational point and said second rotational point are moved in a linear direction radially toward said optical axis of said light beam, along the same radial line, without entering said light beam, whereby a plurality of light formers can be positioned in substantially a same plane, at a same time, inside said light beam to collectively delimit said light beam.

20. An illumination device comprising:

at least one light source generating a light beam, said light beam propagating along an optical axis;

a light effect system for forming the light beam, the light effect system comprising:

a first light former adapted to form at least a part of said light beam;

at least a first actuator adapted to rotate said first light former around a first rotational point and around an axis substantially parallel to an optical axis of said light beam; and at least a second actuator adapted to move said first light former in relation to the optical axis of said light beam, wherein said second actuator is adapted to move said first rotational point in an area outside said light beam and in a linear direction radially to the optical axis of said light beam;

wherein said first light former comprises at least one light effect edge, said at least one light effect edge formed in at least a part of an outer perimeter of said light former and includes a plurality of differently curved edge portions;

wherein said first light former is formed as a light effect wheel having a plane surface between said outer perimeter and said first rotational point; and a projecting system positioned along said optical axis, said projecting system projecting at least a part of said light beam, said projecting system adapted to image at least a part of said at least one light effect edge at a target surface positioned a distance along said optical axis;

wherein said light effect system is positioned at least partially in said light beam and between said light source and said projecting system.

* * * * *